United States Patent [19]

Johnson et al.

[11] Patent Number: 4,875,840

[45] Date of Patent: Oct. 24, 1989

[54] COMPRESSOR LUBRICATION SYSTEM WITH VENT

[75] Inventors: William C. Johnson, Onsted; Hubert Richardson, Jr., Brooklyn; Thomas R. Barito, Tecumseh, all of Mich.

[73] Assignee: Tecumseh Products Company, Tecumseh, Mich.

[21] Appl. No.: 193,548

[22] Filed: May 12, 1988

[51] Int. Cl.[4] ..... F04C 18/04; F04C 29/02; F01M 11/02

[52] U.S. Cl. ..... 418/55; 418/88; 418/94; 184/6.18

[58] Field of Search ..... 418/55 D, 55 E, 88, 418/94; 184/6.16, 6.18

[56] References Cited

U.S. PATENT DOCUMENTS

| | | | |
|---|---|---|---|
| 4,065,279 | 12/1977 | McCullough | 418/55 E |
| 4,216,661 | 8/1980 | Tojo et al. | 418/55 R |
| 4,350,479 | 9/1982 | Tojo et al. | 418/55 D |
| 4,462,772 | 7/1984 | Hazaki et al. | 418/55 E |
| 4,502,852 | 3/1985 | Hazaki | 418/55 E |
| 4,564,339 | 1/1986 | Nakamura et al. | 418/55 E |
| 4,702,681 | 10/1987 | Inaba et al. | 418/55 E |
| 4,772,188 | 9/1988 | Kimura et al. | 418/55 E |
| 4,792,296 | 12/1988 | Kobayashi et al. | 418/55 E |

FOREIGN PATENT DOCUMENTS

| | | | |
|---|---|---|---|
| 58-65986 | 4/1983 | Japan | 418/94 |
| 59-224494 | 12/1984 | Japan | 418/94 |

*Primary Examiner*—John J. Vrablik

*Attorney, Agent, or Firm*—Albert L. Jeffers; John F. Hoffman; David L. Ahlersmeyer

[57] ABSTRACT

A scroll-type hermetic compressor is disclosed including within a hermetically sealed housing a fixed scroll member, an orbiting scroll member, a main bearing frame member, and a crankshaft. An oil sump is located in a discharge pressure chamber in the housing. The crankshaft is journalled by bearings in the frame member and the orbiting scroll member. A centrifugal oil pump supplies lubricating oil from the sump to the bearings through an axial passageway in the crankshaft. A vent allows the pumped oil to return to the sump to reduce leakage of oil and refrigerant into regions at suction pressure.

22 Claims, 5 Drawing Sheets

COMPRESSOR LUBRICATION SYSTEM WITH VENT

BACKGROUND OF THE INVENTION

The present invention relates generally to a hermetic compressor and, more particularly, to such a compressor including an oil sump and a rotatable crankshaft within a housing, wherein the crankshaft has an axial oil passageway through which oil from the oil sump is supplied to remote locations requiring oil.

More specifically, the present invention relates to a hermetic compressor including within a housing a compressor mechanism, i.e., a scroll compressor mechanism, wherein said housing has an oil sump. The compressor mechanism is drivenly coupled to a rotating crankshaft, whereby the mechanism compresses refrigerant fluid for use by a refrigeration system. The rotatable crankshaft is supported within bearings typically requiring lubrication. Accordingly, a lubrication system delivers oil from the oil sump to the bearings for lubrication thereof.

In a typical compressor lubrication system, an axial oil passageway is provided in the crankshaft to provide fluid communication between the oil sump and the bearings and/or other locations requiring oil. Oil from the oil sump is pumped into and through the axial oil passageway by either a differential pressure or centrifugal oil pumping system.

In a differential pressure oil pumping system, a pressure differential between the oil sum and the destination of the oil causes oil to flow through the axial oil passageway. However, several problems arise in such a system due to the relatively large pressure differential experienced. For instance, a high oil flow rate is induced which causes excessive oil leakage into the refrigeration system, thereby resulting in refrigeration system inefficiencies. Efforts to reduce the oil flow rate by throttling the oil delivery passages, i.e., restricting the passages, leads to further problems including clogging of the passageways and very low oil flow rates through the axial passageway. In the event of such restrictions in flow-controlling oil delivery passageways, the differential pressure system experiences oil stack-up in the axial passageway. A slow oil flow rate and oil stack-up can increase the temperature of the oil in the axial oil passageway, thereby causing oil breakdown and possible damage to the bearings.

In a typical centrifugal oil pumping system, an oil pump is operable upon rotation of the crankshaft to pump oil into the axial oil passageway at one end of the crankshaft. The oil flows through the passageway and is then vented through a vent hole located at the other end of the crankshaft. Intermediate the two crankshaft ends, oil is supplied to various locations requiring oil. Such a system is commonly used in certain types of compressors, i.e., reciprocating piston, scotch-yoke, and rotary vane, wherein the vent hole is uncovered and in open communication with the interior of the housing, including the oil sump.

However, a problem can arise when a centrifugal oil pumping system is used in a scroll-type compressor, because the end of the crankshaft having the vent hole is adjacent the bottom surface of the scroll. In such an arrangement, the crankshaft and the orbiting scroll member define a substantially closed fluid chamber with which the vent hole communicates. The closed fluid chamber inhibits venting of the axial oil passageway thereby causing slow oil flow rates and the problems associated therewith. Furthermore, at compressor start-up when the axial oil passageway may be filled with gas, the gas is not as quickly vented out, but is instead required to escape through bearings and the like. Consequently, a delay in supplying oil to the bearings is experienced, which may damage or cause premature failure of the bearings.

The present invention is directed to overcoming the aforementioned problems associated with a compressor oil delivery system, wherein it is desired to provide improved venting of the axial oil passageway in a crankshaft to prevent slow oil flow rates therethrough.

SUMMARY OF THE INVENTION

The present invention overcomes the problems and disadvantages of the above-described prior art compressors by providing an improved compressor oil delivery system, wherein oil pumped from an oil sump through an axial oil passageway in a rotatable crankshaft is vented back to the oil sump, whereby an adequate flow of oil through the axial passageway is maintained.

Generally, the present invention provides a hermetically sealed compressor comprising a housing including therein an oil sump, a compressor mechanism, and a rotatable crankshaft. An oil pump is operable upon rotation of the crankshaft to pump oil from the oil sump through a first axial oil passageway in the crankshaft. The oil pumped through the first passageway is then vented through a second axial oil passageway in the crankshaft back to the oil sump. Accordingly, flow of oil through the first oil passageway is promoted.

More specifically, the present invention provides, in one form thereof, an oil delivery system for a hermetic scroll-type compressor, wherein oil from an oil sump is pumped through an axial oil passageway in a rotating crankshaft to a substantially closed fluid chamber defined by the crankshaft and an orbiting scroll member. Fluid is vented from the fluid chamber by means of a second axial oil passageway through the crankshaft. In one form of the invention, the crankshaft is rotatably journalled in a frame member, whereby the frame member and crankshaft define an annular space in fluid communication with the second axial oil passageway in the crankshaft. A vent hole extends through the frame to provide fluid communication between the annular space and the oil sump.

An advantage of the compressor of the present invention is the provision of an oil delivery system wherein an adequate flow rate is maintained for oil being pumped through an axial oil passageway in the crankshaft.

Another advantage of the compressor of the present invention is that upon compressor start-up, gaseous fluid in the axial oil passageway of the crankshaft is quickly vented to prevent possible damage to bearings and the like.

A further advantage of the compressor of the present invention is that the increased oil flow rate through the axial oil passageway of the crankshaft helps keep the oil temperature at safe levels.

Yet another advantage of the compressor of the present invention is that excessive pressure build-up of the oil pumped through the axial oil passage into substantially closed chambers is avoided, thereby reducing oil leakage out of the chambers and into the refrigeration system.

A still further advantage of the compressor of the present invention is that the improved oil flow rate through the axial oil passageway helps remove heat from the crankshaft bearings, thereby prolonging bearing life.

Another advantage of the compressor of the present invention is that flow of oil along the entire length of the crankshaft is promoted.

The compressor of the present invention, in one form thereof, provides a housing including an oil sump therein. A compressor mechanism for compressing refrigerant fluid is provided within the housing. The compressor mechanism ijs drivingly engaged by a rotatably crankshaft. The crankshaft includes a first generally axial oil passageway extending therethrough. A pump is operable upon rotation of the crankshaft to pump oil from the oil sump through the first axial oil passageway. A vent, including a second generally axial oil passageway extending through the crankshaft, is provided for returning oil pumped into the first oil passageway back to the oil sump. The first oil passageway is in fluid communication with the second oil passageway.

The invention further provides, in one form thereof, a hermetic scroll compressor including a housing having a discharge pressure chamber therein. An oil sump is located within the discharge pressure chamber. A scroll compressor mechanism, including an orbiting scroll member, is provided within the housing. A rotatable crankshaft is operably coupled to the orbiting scroll member to impart orbiting motion thereto for compressing refrigerant fluid. An oil delivery system, including a first generally axial oil passageway in the crankshaft, supplies oil from the oil sump to a substantially closed oil chamber defined by the orbiting scroll member and the crankshaft. An oil vent, including a second generally axial oil passageway in the crankshaft, vents oil from the oil chamber into the discharge pressure chamber of the housing.

DESCRIPTION OF THE PREFERRED EMBODIMENT

Figure 1:
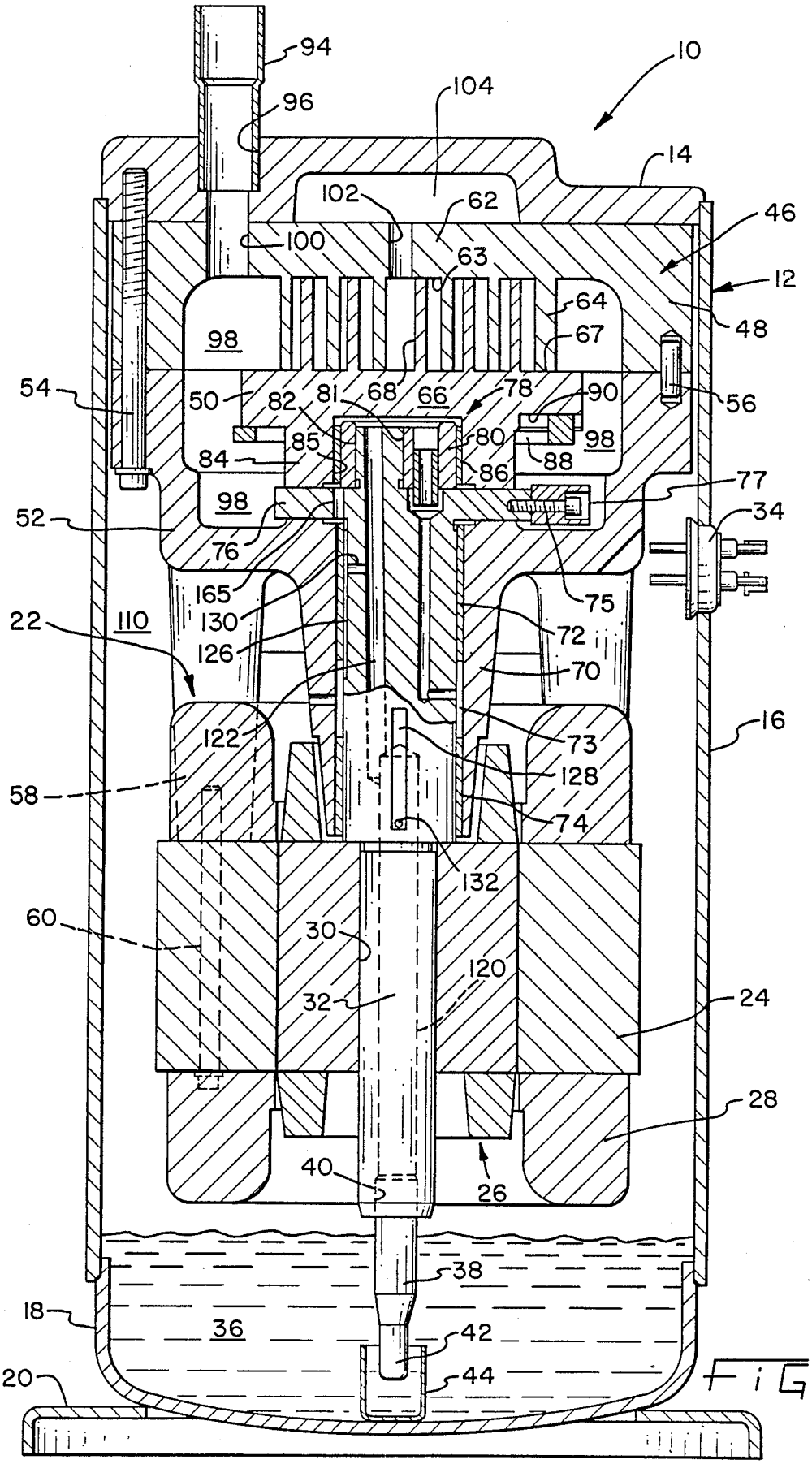
FIG. 1 is a longitudinal sectional view of a compressor of the type to which the present invention pertains, taken along the line 1—1 in FIG. 3 and viewed in the direction of the arrows.
Figure 2:
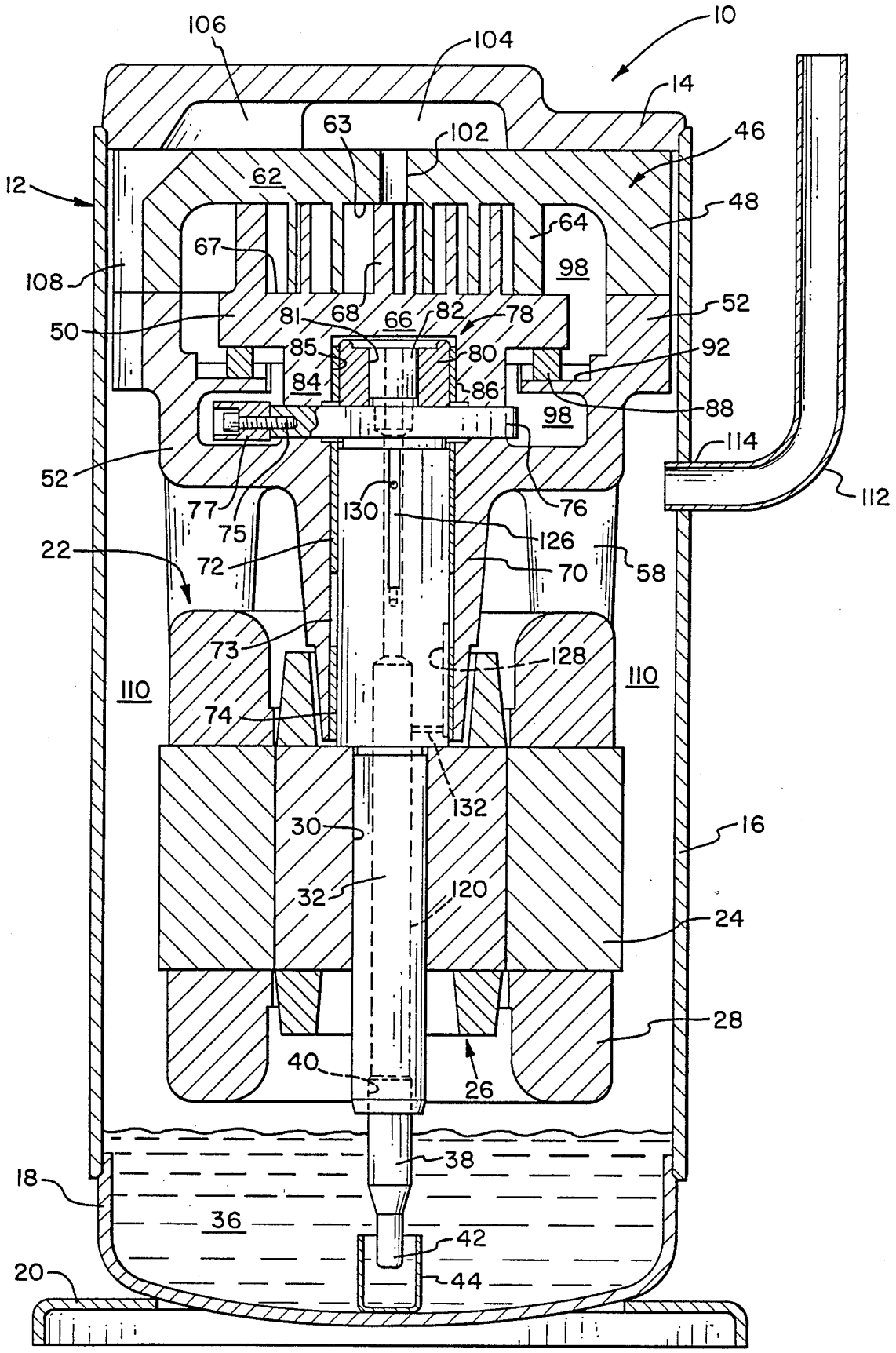
FIG. 2 is a longitudinal sectional view of the compressor of FIG. 1, taken along the line 2—2 in FIG. 3 and viewed in the direction of the arrows.
Figure 3:
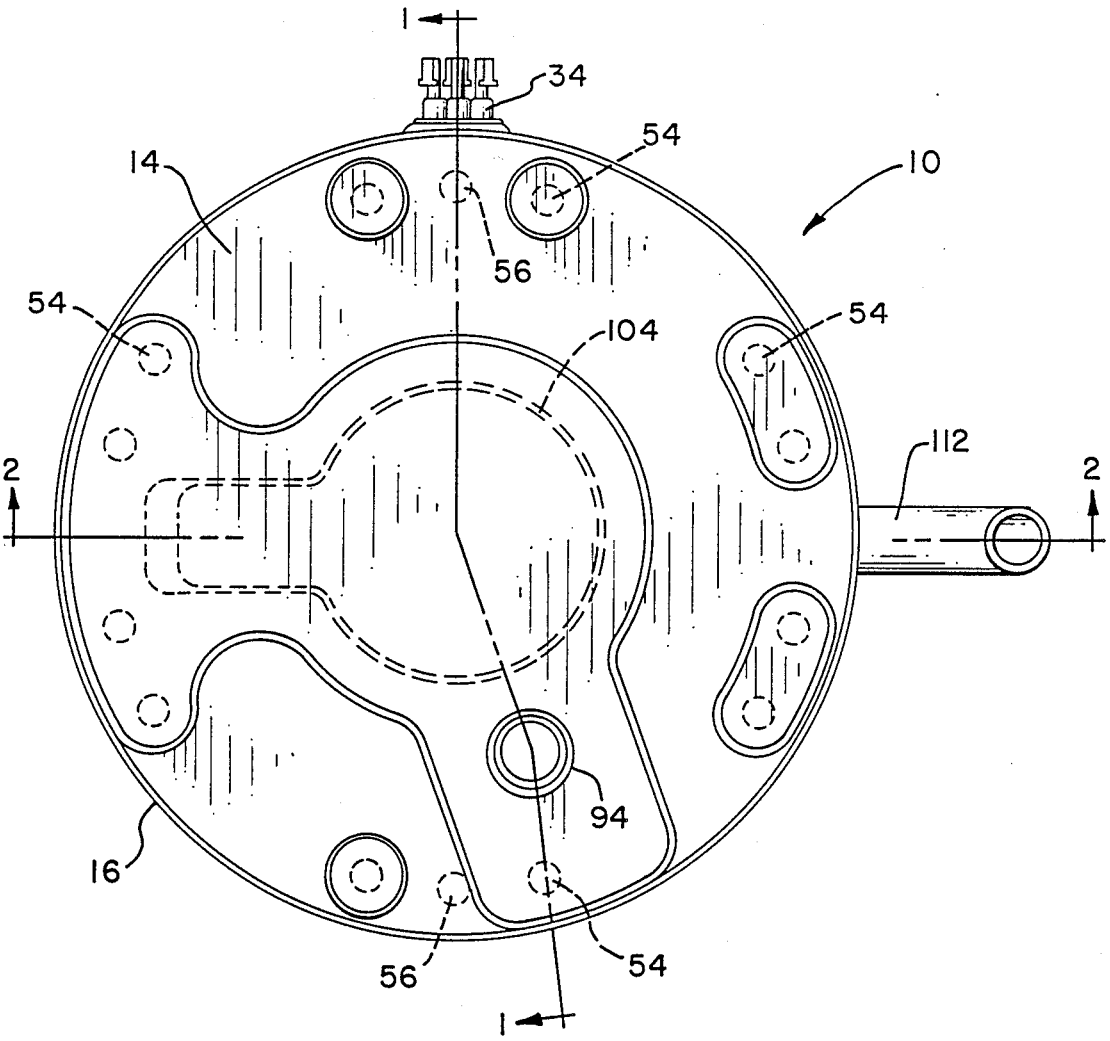
FIG. 3 is an enlarged top view of the compressor of FIG. 1.

In an exemplary embodiment of the invention as shown in the drawings, and in particular by referring to FIGS. 1-3, a compressor 10 is shown having a housing generally designated at 12. The housing has a top cover plate 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position. Located within hermetically sealed housing 12 is an electric motor generally designated at 22, having a stator 24 and a rotor 26. Stator 24 is provided with windings 28. Rotor 26 has a central aperture 30 provided therein into which is secured a crankshaft 32 by an interference fit. A terminal cluster 34 is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, nonagitated oil is drawn.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 1, fixed scroll member 48 and frame member 52 are secured together and are attached to top cover plate 14 by means of a plurality of mounting bolts 54. Precise alignment between fixed scroll member 48 and frame member 52 is accomplished by a pair of locating pins 56. Frame member 52 includes a plurality of mounting pads 58 to which motor stator 24 is attached by means of a plurality of mounting bolts 60, such that there is an annular gap between stator 24 and rotor 26.

Fixed scroll member 48 comprises a generally flat face plate 62 having a face surface 63, and an involute fixed wrap 64 extending axially from surface 63. Likewise, orbiting scroll member 50 comprises a generally flat face plate 66 having a top face surface 67, and an involute orbiting wrap 68 extending axially from surface 67. Fixed scroll member 48 and orbiting scroll member 50 are assembled together so that fixed wrap 64 and orbiting wrap 68 operatively interfit with each other. Furthermore, face surfaces 63, 67 and wraps 64, 68 are manufactured or machined such that, during compressor operation when the fixed and orbiting scroll members are forced axially toward one another, the tips of wraps 64, 68 sealingly engage with respective opposite face surfaces 67, 63.

Main bearing frame member 52, as shown in FIGS. 1 and 2, comprises a downwardly extending bearing portion 70. Retained within bearing portion 70, as by press fitting, is a conventional sleeve bearing assembly comprising an upper bearing 72 and a lower bearing 74. Two sleeve bearings are preferred rather than a single longer sleeve bearing to facilitate easy assembly into bearing portion 70 and to provide an annular space 73 between the two bearings 72, 74. Accordingly, crankshaft 32 is rotatably journalled within bearings 72, 74.

Crankshaft 32 includes a concentric thrust plate 76 extending radially outwardly from the sidewall of crankshaft 32. A balance weight 77 is attached to thrust plate 76, as by bolts 75. Situated on the top of crankshaft 32 is an eccentric crank mechanism 78. According to a preferred embodiment, crank mechanism 78 comprises a cylindrical roller 80 having an axial bore 81 extending therethrough at an off-center location. An eccentric crankpin 82, constituting the upper, offset portion of crankshaft 32, is received within bore 81, whereby roller 80 is eccentrically journalled about eccentric crankpin 82. Orbiting scroll member 50 includes a lower hub portion 84 that defines a cylindrical well 85 into which roller 80 is received. Roller 80 is journalled for rotation within well 85 by means of a sleeve bearing 86, which is press fit into well 85. Each of sleeve bearings 72, 74, and 86 is preferably a steel-backed bronze bushing.

When crankshaft 32 is rotated by motor 22, the operation of eccentric crankpin 82 and roller 80 within well 85 causes orbiting scroll member 50 to orbit with respect to fixed scroll member 48. Roller 82 pivots slightly about crankpin 80 so that crank mechanism 78 functions as a conventional swinglink radial compliance mechanism to promote sealing engagement between fixed wrap 64 and orbiting wrap 68. Orbiting scroll member 50 is prevented from rotating about its own axis by means of a conventional Oldham ring assembly, comprising an Oldham ring 88, and Oldham key pairs 90, 92 associated with orbiting scroll member 50 and frame member 52, respectively.

In operation of compressor 10 of the preferred embodiment, refrigerant fluid at suction pressure is introduced through suction pipe 94, which is received within a counterbore 96 in top cover plate 14 and is attached thereto as by silver soldering or brazing. A suction pressure chamber 98 is generally defined by fixed scroll member 48 and frame member 52. Refrigerant is introduced into chamber 98 from suction tube 94 through a suction passageway 100 defined by aligned holes in top cover plate 14 and fixed scroll member 48. As orbiting scroll member 50 is caused to orbit, refrigerant fluid within suction pressure chamber 98 is compressed radially inwardly by moving closed pockets defined by fixed wrap 64 and orbiting wrap 68.

Refrigerant fluid at discharge pressure in the innermost pocket between the wraps is discharged upwardly through a discharge port 102 communicating through face plate 62 of fixed scroll member 48. Compressed refrigerant discharged through port 102 enters a discharge plenum chamber 104 defined by the underside of top cover plate 14. A radially extending duct 106 formed in top cover plate 14 and an axially extending duct 108 extending along the side of fixed scroll member 48 and frame member 52 allow the compressed refrigerant in discharge plenum chamber 104 to be introduced into housing chamber 110 defined within housing 12. As shown in FIG. 2, a discharge tube 112 extends through central portion 16 of housing 12 and is sealed thereat as by silver solder 114. Discharge tube 112 allows pressurized refrigerant within housing chamber 110 to be delivered to the refrigeration system (not shown) in which compressor 10 is incorporated.

Figure 4:
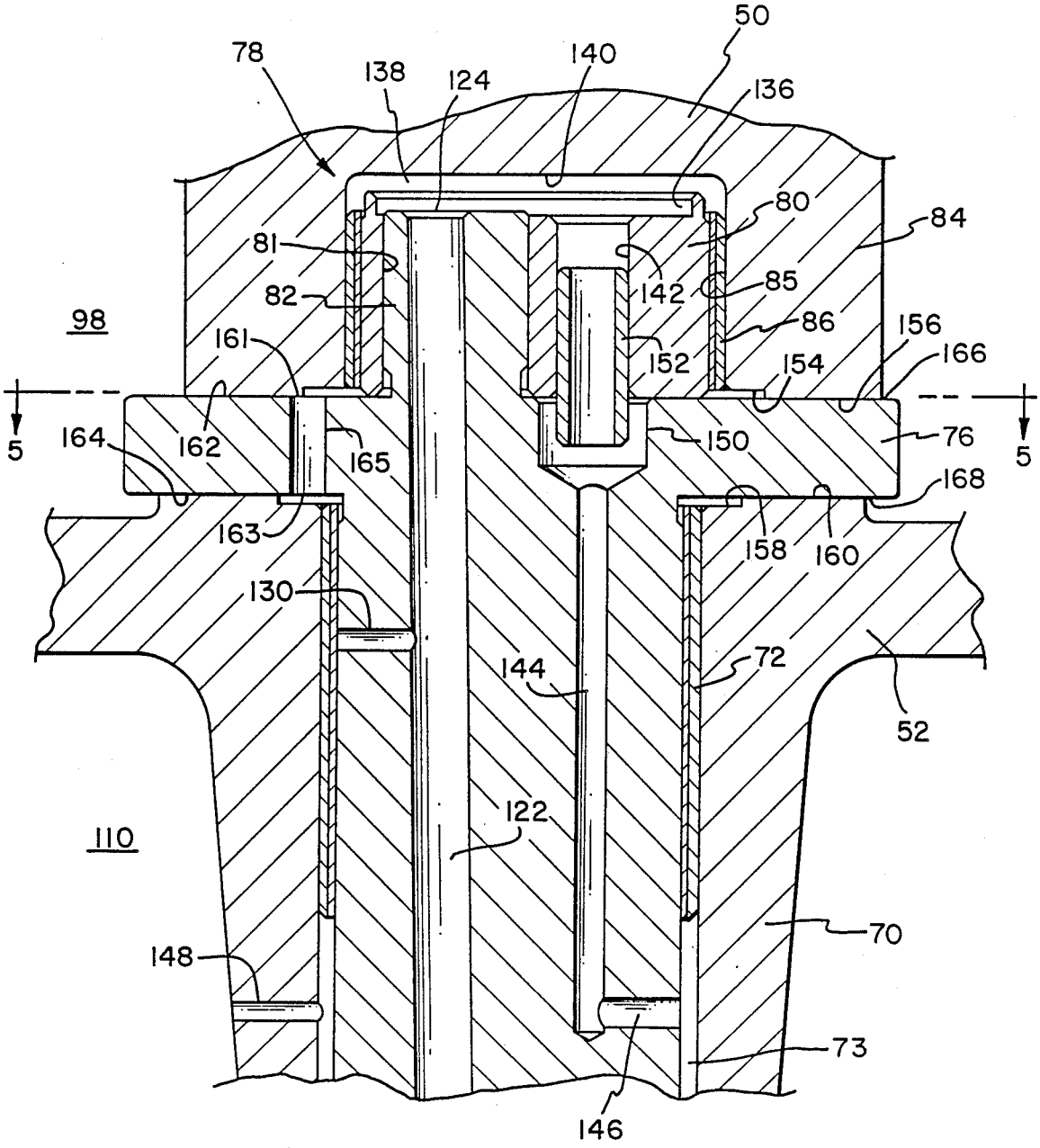
FIG. 4 is an enlarged fragmentary sectional view of the compressor of FIG. 1, particularly showing a significant portion of a compressor lubrication system in accordance with a preferred embodiment of the present invention.

Reference will now be made to FIGS. 1, 2, and 4 for a general discussion of the lubrication system of compressor 10. An axial oil passageway 120 is provided in crankshaft 32, which communicates with tube 38 and extends upwardly along the central axis of crankshaft 32. At a central location along the length of crankshaft 32, an offset, radially divergent oil passageway 122 intersects passageway 120 and extends to an opening 124 on the top of eccentric crankpin 82 at the top of crankshaft 32. As crankshaft 32 rotates, oil pickup tube 38 draws lubricating oil from oil sump 36 and causes oil to move upwardly through oil passageways 120 and 122. As shown in FIGS. 1 and 2, lubrication of upper bearing 72 and lower bearing 74 is accomplished by means of flats 126 and 128 in crankshaft 32, located in the general vicinity of bearings 72 and 74, respectively. Flat 126 communicates with offset oil passageway 122 by means of a radial passage 130, while flat 128 communicates with axial oil passageway 120 by means of a radial passage 132. As illustrated in FIGS. 1 and 2, flats 126 and 128 extend axially along the length of crankshaft 32, and are located relative to bearings 72 and 74 so as to overlap and communicate with annular space 73.

Referring now to FIG. 4, lubricating oil pumped upwardly through offset oil passageway 122 exits crankshaft 32 through opening 124 located on the top of eccentric crankpin 82. A counterbore 136 in the top surface of roller 80 provides a reservoir into which oil from hole 124 is introduced. Lubricating oil within counterbore 136 will tend to flow downwardly along the interface between bore 81 and crankpin 82 for lubrication thereof. A flat on crankpin 82 (not shown) may be provided to enhance lubrication.

Lubrication delivered from hole 124 not only fills counterbore 136, but also fills a fluid chamber 138 within well 85, defined by bottom surface 140 of well 85 and the top surface of crank mechanism 78, including roller 80 and crankpin 82. Oil within chamber 138 tends to flow downwardly along the interface between roller 80 and sleeve bearing 86 for lubrication thereof. A flat (not shown) may be provided in the outer cylindrical surface of roller 80 to enhance lubrication.

The lubrication system of compressor 10 further includes a vent for returning the oil that is pumped from sump 36 to counterbore 136 and chamber 138, back to sump 36. Specifically, an axially extending vent bore 142 is provided in roller 80, which provides communication between the top and bottom surfaces thereof. An axial vent passageway 144 extends axially through crankshaft 32 from the top surface of thrust plate 76 to a location along the length of crankshaft 32 adjacent annular space 73. A radial vent passageway 146 extends radially from axial passageway 144 to an outer surface of crankshaft 32 partially defining annular space 73. Furthermore, a vent hole 148 is provided through bearing portion 70 to provide communication between annular space 73 and housing chamber 110.

During venting of the lubrication system of compressor 10, lubricating oil is pumped upwardly through axial oil passageway 120 and offset oil passageway 122 by the operation of centrifugal oil pick-up tube 38. Upon leaving passageway 122 through opening 124, the oil collects in counterbore 136 and chamber 138 and is also vented downwardly through vent bore 142. Vent bore 142 is generally aligned with the upper portion of axial vent passageway 144 at the interface between roller 80 and thrust plate 76. Therefore, oil flowing downwardly through vent bore 142 continues to flow through vent passageway 144, and then radially outwardly into annular space 73 through radial vent passageway 146. Oil contained within annular space 73, whether deposited there as the result of venting or as the result of the previously described lubrication of bearing 72 and 74, is metered back into housing chamber 110 through vent hole 148.

While venting of the lubrication system has been described in terms of maintaining oil flow through axial oil passageways 120, 122, it will be appreciated that the venting also permits quick removal of gaseous or liquid refrigerant fluid that may initially reside within passageways 120, 122 at compressor start-up. Accordingly, the lubrication system venting arrangement allows lubricating oil to be quickly supplied to the bearings and other needed locations so as to avoid damage to the bearings and other compressor components.

As discussed previously with respect to the swing-link radial compliance mechanism of the preferred embodiment, roller 80 pivots slightly with respect to crankpin 82 to effect radial compliance of orbiting scroll member 50 against fixed scroll member 48. Accordingly, in order to maintain generally aligned communication between vent bore 142 and axial vent passageway 144, the upper portion of passageway 144 adjacent the top surface of thrust plate 76 comprises a pocket 150 having a diameter greater than that of vent bore 142. In this manner, roller 80 may experience limited pivotal motion while maintaining fluid communication between vent bore 142 and axial vent passageway 144. As shown in FIG. 4, a hollow roll pin 152 is press fit into vent bore 142 and extends from the bottom of roller 80 into the void defined by pocket 150. Oil may continue to flow through roll pin 152 to maintain fluid communication between vent bore 142 and axial passageway 144, however, roller 80 is restrained from pivoting completely about crankpin 82. This restraint against pivoting is used primarily during assembly to keep roller 80 within a range of positions to ensure easy assembly of orbiting scroll member 50 and fixed scroll member 48.

Referring now to FIG. 4 for a description of the axial compliance mechanism of compressor 10, lubricating oil at discharge pressure is provided by the aforementioned lubrication system to the underside of orbiting scroll member 50 within well 85 thereof. More specifically, when the lubricating oil fills chamber 138, an upward force acts upon orbiting scroll member 50 toward fixed scroll member 48. The magnitude of the upward force is determined by the surface area of bottom surface 140. In order to increase the upward force on orbiting scroll member 50, a shallow counterbore 154 is provided in a bottom surface 156 of orbiting scroll member 50 immediately adjacent, i.e., circumjacent, the opening of well 85. Counterbore 154 provides additional surface area on bottom surface 156 to which lubricating oil at discharge pressure may be exposed to create an upward force on orbiting scroll member 50.

In order to keep the forces acting on crankshaft 32 essentially at equilibrium, i.e., exposing the top and bottom of the crankshaft to the same pressures, a counterbore 158 is provided in a top surface 160 of main bearing frame member 52 immediately adjacent, i.e., circumjacent, the opening of bearing portion 70. In this manner, equal areas of a top surface 162 and a bottom surface 164 of thrust plate 76 are exposed to the lubricating oil at discharge pressure within counterbore 154 and counterbore 158, respectively. Additionally, a pressure equalization port 165 may be provided in thrust plate 76 to insure that the oil within counterbores 154 and 158 is at the same pressure. Port 165 extends between an opening 161 on top surface 162 and an opening 163 on bottom surface 164, and provides communication between counterbores 154 and 158.

In one embodiment of compressor 10, particularly shown in FIG. 4, the lubricating oil at discharge pressure within counterbores 154, 158 is sealingly separated from suction pressure chamber 98, located radially outwardly therefrom, by slightly leaky hydrodynamic seals comprising top interface 166 defined by closely spaced top surface 162 and bottom surface 156, and bottom interface 168 defined by closely spaced bottom surface 164 and top surface 160, respectively. In order to achieve the desired hydrodynamic seal, the respective top and bottom surfaces should be machined flat and the clearance within interfaces 166 and 168 should be maintained between 0.0001 and 0.0005 inches. Alternatively, an annular seal element may be disposed within each of the interfaces 166 and 168, thereby permitting greater clearances within the interfaces.

Figure 5:
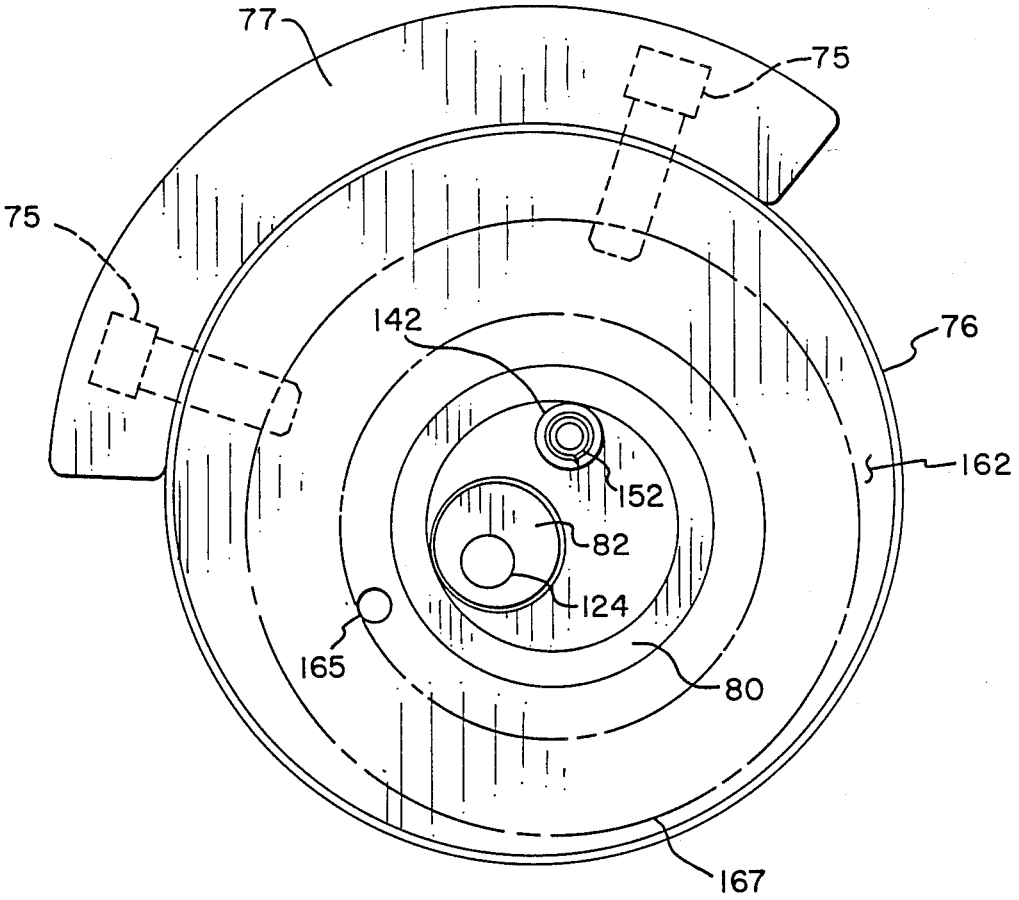
FIG. 5 is an enlarged fragmentary sectional view of the compressor of FIG. 1, taken along the line 5—5 in FIG. 4 and viewed in the direction of the arrows, particularly showing the crank mechanism on the top surface of the crankshaft thrust plate, including elements relating to the compressor lubrication system.

FIG. 5 illustrates the orientation of equalization port 165 on top surface 162 of thrust plate 76. More specifically, pressure equalization port 165 is shown radially positioned between roller 80 and the aforementioned hydrodynamic seal comprising top interface 166. A projection of interface 166 onto top surface 162 is represented by a ringed area 167, delineated by phantom lines in FIG. 5. Accordingly, lubricating oil at discharge pressure is retained radially inward from interface 166.

Crankshaft 32 of the preferred embodiment of the present invention has been generally shown and described as having a first oil passageway comprising passageways 120, 122, and a second oil passageway comprising vent bore 142 and passageway 144. The disclosed first and second oil passageways extend generally axially with respect to the crankshaft, in substantially parallel relationship with one another. However the term generally axially, as used herein to describe the first and second oil passageways, is to be understood as also describing any passageway that extends at a slight acute angle with respect to the crankshaft axis. For instance, axial vent passageway 144 could extend directly between the top surface of thrust plate 76 and the outer surface of crankshaft 32 partially defining annular space 73, thereby eliminating the need for radial vent passageway 146.

It will be appreciated that the foregoing description of various embodiments of the invention is presented by way of illustration only and not by way of any limitation, and that various alternatives and modifications may be made to the illustrated embodiments without departing from the spirit and scope of the invention.

What is claimed is:

1. A hermetic compressor, comprising:

a housing;

an oil sump within said housing;

compressor means within said housing for compressing refrigerant fluid, said compressor means including a drive input comprising a bearing;

a rotatable crankshaft having a first end portion disposed within said oil sump and a second opposite end portion rotatably journalled within said bearing, said crankshaft including a first generally axial oil passageway in fluid communication with said oil sump and extending the length of said crankshaft through said first and second end portions thereof;

pump means, operable upon rotation of said crankshaft, for pumping oil from said oil sump through said first oil passageway; and vent means, including a second generally axial oil passageway extending through said second end portion of said crankshaft, for returning oil pumped through said first oil passageway back to said oil sump, said first oil passageway being in fluid communication with said second oil passageway.

2. The hermetic compressor of claim 1 and further comprising:

fluid communication means, external said crankshaft, for providing fluid communication between said first oil passageway and said second oil passageway.

3. The hermetic compressor of claim 2 in which:

said drive input comprises a well in which said second end portion is rotatably journalled, said well portion and said second end portion defining a fluid chamber, said fluid communication means comprising said fluid chamber.

4. The compressor of claim 1, and further comprising:

a frame member for rotatably supporting said crankshaft, said crankshaft and said frame member defining an annular space, said second oil passageway including a radially extending passage in fluid communication with said annular space, said frame member including a vent hole providing fluid communication between said annular space and said oil sump.

5. The compressor of claim 1 in which:

said pump means comprises a centrifugal oil pump attached to said first end of said crankshaft and in fluid communication with said oil sump.

6. The compressor of claim 1 in which:

said compressor means is a scroll compressor mechanism having an orbiting scroll member, and said crankshaft includes a coupling end adjacent said orbiting scroll member, said coupling end and said orbiting scroll member defining a substantially closed chamber, said first and second oil passageways being in fluid communication with said closed chamber.

7. The compressor of claim 6, and further comprising:

a frame member for rotatably supporting said crankshaft, said crankshaft and said frame member defining an annular space, said second oil passageway including a radially extending passage in fluid communication with said annular space, said frame member including a vent hole providing fluid communication between said annular space and said oil sump.

8. A hermetic scroll compressor for compressing refrigerant fluid, comprising:

a housing including a discharge pressure chamber;

an oil sump within said discharge pressure chamber;

a scroll compressor mechanism within said housing, said mechanism including an orbiting scroll member having a drive input comprising a bearing;

a rotatable crankshaft operably coupled to said orbiting scroll member to impart orbiting motion thereto for compressing refrigerant fluid, said crankshaft having a first end portion disposed within said oil sump and a second opposite end portion rotatably journalled within said bearing;

oil delivery means, including a first generally axial oil passageway in said crankshaft in fluid communication with said oil sump, for supplying oil from said oil sump to a substantially closed oil chamber defined by said orbiting scroll member and said crankshaft, said first oil passageway extending the length of said crankshaft through said first and second end portions thereof; and oil venting means, including a second generally axial oil passageway in said crankshaft, for venting oil from said oil chamber into said discharge pressure chamber, said second oil passageway being in fluid communication with said oil chamber and extending through said second end portion of said crankshaft.

9. The scroll compressor of claim 8 in which:

said crankshaft includes a radially extending plate portion and an eccentric crank portion extending axially from an end surface of said plate portion, said crank portion operatively engaging said orbiting scroll member, said first oil passageway having an opening on an end surface of said crank portion and said second oil passageway having an opening on said plate portion end surface.

10. The scroll compressor of claim 9, and further comprising:

a roller member pivotally circumjacent said crank portion, said roller member being rotatably journalled within a well formed in said orbiting scroll member, said well and said roller defining said oil chamber, said roller including a roller oil passageway providing fluid communication between said oil chamber and said opening on said plate portion end surface.

11. The scroll compressor of claim 8, and further comprising:

a frame member for rotatably supporting said crankshaft, said crankshaft and said frame member defining an annular space, said second oil passageway including a radially extending passage in fluid communication with said annular space, said frame member including a vent hole providing fluid communication between said annular space and said discharge pressure chamber.

12. The compressor of claim 8 in which:

said oil delivery means comprises a centrifugal oil pump attached to an end of said crankshaft, said pump being in fluid communication with said oil sump and being operable upon rotation of said crankshaft to pump oil from said sump through said first oil passageway.

13. A hermetic scroll compressor for compressing refrigerant fluid, comprising:

a housing;

an oil sump within said housing;

a fixed scroll member and an orbiting scroll member, each including a respective involute wrap element, said respective wrap elements being intermeshed to define at least one pocket of refrigerant fluid compressed by orbiting motion of said orbiting scroll member with respect to said fixed scroll member, said orbiting scroll member including a bottom surface;

a rotatable crankshaft including a journal portion operably coupled to said orbiting scroll member to impart orbiting motion thereto, said crankshaft having a coupling end adjacent said orbiting scroll member bottom surface, said crankshaft including a first generally axial oil passageway extending the length of said crankshaft through said journal portion and providing fluid communication between said oil sump and a fluid chamber defined by said coupling end and said orbiting scroll member bottom surface;

pump means, operable upon rotation of said crankshaft, for pumping oil from said oil sump through said first axial oil passageway; and vent means, including a second generally axial oil passageway extending through said journal portion of said crankshaft, for returning oil pumped into said first oil passageway back to said oil sump, said second oil passageway being in fluid communication with said fluid chamber, whereby oil from said oil sump is pumped through said first oil passageway into said fluid chamber and is returned to said oil sump through said vent means.

14. The scroll compressor of claim 13, and further comprising:

a frame member for rotatably supporting said crankshaft, said crankshaft and said frame member defining an annular space, said second oil passageway including a radially extending passage in fluid communication with said annular space, said frame member including a vent hole providing fluid communication between said annular space and said discharge pressure chamber.

15. The compressor of claim 14 in which:

said annular space is defined axially between a pair of sleeve bearings within said frame member, said sleeve bearings rotatably supporting said crankshaft.

16. The compressor of claim 14 in which:

said crankshaft includes a radially extending plate portion and an eccentric crank portion extending axially from an end surface of said plate portion, said crank portion operatively engaging said orbiting scroll member, said first oil passageway having an opening on an end surface of said crank portion and said second oil passageway having an opening on said plate portion end surface, and further comprising:

a roller member pivotally circumjacent said crank portion, said roller member being rotatably journalled within a well formed in said orbiting scroll member, said well and said roller defining said fluid chamber, said roller including a roller oil passageway providing fluid communication between said fluid chamber and said opening on said plate portion end surface.

17. A vertical hermetic scroll compressor for compressing refrigerant fluid, comprising:

a vertically upstanding housing including a discharge pressure chamber having an oil sump located therein at the bottom of said housing;

a fixed scroll member within said housing, said fixed scroll member including an involute fixed wrap element on a bottom surface thereof;

an orbiting scroll member including an orbiting wrap element on a top surface thereof, said fixed and orbiting wrap elements being intermeshed to define at least one pocket of refrigerant fluid compressed by orbiting motion of said orbiting scroll member with respect to said fixed scroll member, said orbiting scroll member including a bottom surface;

a vertical rotatable crankshaft including a lower end, a central journal portion, and an upper end adjacent said orbiting scroll member bottom surface, said upper end including an upper journal portion operably coupled to said orbiting scroll member to impart orbiting motion thereto, said crankshaft including a first generally axial oil passageway extending from said lower end to said upper end thereof through said upper journal portion, said oil passageway being in fluid communication with said oil sump at said lower end;

a frame member attached to said fixed scroll member, said frame member including a bearing portion in which said crankshaft central journal portion is rotatably journalled, said bearing portion and said central journal portion defining an annular space therebetween;

pump means, operable upon rotation of said crankshaft, for pumping oil from said oil sump through said first axial oil passageway; and oil vent means for permitting flow of oil from said oil sump through said first oil passage and back to said oil sump, said oil vent means generally comprising: a second axial oil passageway in said crankshaft extending from said upper end and through said upper journal portion to an axial location along said journal portion; means for providing fluid communication between said first and second oil passages at said crankshaft upper end; a radial oil passageway providing fluid communication between said second oil passageway and said annular space; and a vent hole through said frame member bearing portion providing fluid communication between said annular interface and said discharge chamber, whereby oil flows upwardly through said first oil passageway, downwardly through said second oil passageways, and through said vent hole into said discharge chamber and oil sump therein.

18. The compressor of claim 17 in which:

said annular space is defined axially between a pair of sleeve bearings within said frame member, said sleeve bearings rotatably supporting said crankshaft.

19. The compressor of claim 17 in which:

said means for providing fluid communication between said first and second oil passageways comprising a substantially closed fluid chamber defined by said orbiting scroll member and said crankshaft, said first and second oil passageways being in fluid communication with said fluid chamber.

20. The compressor of claim 17 in which:

said crankshaft includes a radially extending plate portion and an eccentric crank portion extending upwardly from a top surface of said plate portion, said crank portion operatively engaging said orbiting scroll member, said first oil passageway having an opening on a top surface of said crank portion and said second oil passageway having an opening on said plate portion top surface, and further comprising:

a roller member pivotally circumjacent said crank portion, said roller member being rotatably journalled within a well formed in said orbiting scroll member bottom surface, said well and said roller defining said fluid chamber, said roller including a roller oil passageway providing fluid communication between said fluid chamber and said opening on said plate portion top surface.

21. A hermetic scroll compressor for compressing refrigerant fluid, comprising:

a housing including a discharge pressure chamber;

an oil sump within said discharge pressure chamber;

a scroll compressor mechanism within said housing, said mechanism including an orbiting scroll member;

a rotatable crankshaft operably coupled to said orbiting scroll member to impart orbiting motion thereto for compressing refrigerant fluid;

oil delivery means, including a first generally axial oil passageway in said crankshaft in fluid communication with said oil sump, for supplying oil from said oil sump to a substantially closed oil chamber defined by said orbiting scroll member and said crankshaft; and oil venting means, including a second generally axial oil passageway in said crankshaft, for venting oil from said oil chamber into said discharge pressure chamber;

said crankshaft including a radially extending plate portion and an eccentric crank portion extending axially from an end surface of said plate portion, said crank portion operatively engaging said orbiting scroll member, and said first oil passageway having an opening on an end surface of said crank portion and said second oil passageway having an opening on said plate portion end surface.

22. The scroll compressor of claim 21, and further comprising:

a roller member pivotally circumjacent said crank portion, said roller member being rotatably journalled within a well formed in said orbiting scroll member, said well and said roller defining said oil chamber, said roller including a roller oil passageway providing fluid communication between said oil chamber and said opening on said plate portion end surface.

* * * * *